US008390419B2

(12) United States Patent
Fiseni et al.

(10) Patent No.: US 8,390,419 B2
(45) Date of Patent: Mar. 5, 2013

(54) ELECTRICAL ASSEMBLY AND METHOD FOR MAKING THE SAME

(75) Inventors: Alexander Felix Fiseni, Munich (DE); Jan Hemmelmann, Munich (DE)

(73) Assignee: General Electric Company, Niskayuna, NY (US)

( * ) Notice: Subject to any disclaimer, the term of this patent is extended or adjusted under 35 U.S.C. 154(b) by 36 days.

(21) Appl. No.: 12/974,494

(22) Filed: Dec. 21, 2010

(65) Prior Publication Data

US 2011/0221555 A1 Sep. 15, 2011

(51) Int. Cl.
*H01F 27/24* (2006.01)

(52) U.S. Cl. ..... 336/234

(58) Field of Classification Search ..... 336/212, 336/234, 210; 310/216–217, 12–39
See application file for complete search history.

(56) References Cited

U.S. PATENT DOCUMENTS

| | | | | |
|---|---|---|---|---|
| 3,502,914 | A | 3/1970 | Cox | |
| 4,151,430 | A * | 4/1979 | Stark | 310/90 |
| 5,157,297 | A * | 10/1992 | Uchida | 310/156.61 |
| 5,587,859 | A | 12/1996 | Nagatsuka | |
| 5,881,446 | A * | 3/1999 | Shiga et al. | 29/596 |
| 5,894,653 | A | 4/1999 | Nakamura et al. | |
| 5,945,748 | A * | 8/1999 | Park et al. | 310/12.23 |
| 6,133,669 | A * | 10/2000 | Tupper | 310/263 |
| 6,915,558 | B2 | 7/2005 | Jin et al. | |
| 7,049,925 | B2 * | 5/2006 | Kawano et al. | 336/234 |
| 7,663,462 | B2 | 2/2010 | Makuth et al. | |
| 2003/0080634 | A1 | 5/2003 | Kwon et al. | |
| 2003/0102725 | A1 | 6/2003 | Jeon et al. | |
| 2010/0148505 | A1 | 6/2010 | Dunlap et al. | |

FOREIGN PATENT DOCUMENTS

EP 1580427 A2 9/2005

OTHER PUBLICATIONS

Search Report and Written Opinion from corresponding EP Application No. 11193667.0-2208 dated May 24, 2012.

* cited by examiner

*Primary Examiner* — Tuyen Nguyen
(74) *Attorney, Agent, or Firm* — Ann M. Agosti

(57) ABSTRACT

An electrical assembly for use with a rotary transformer is provided. The electrical assembly includes a assembly structure having a first flange positioned proximate a first end portion of the assembly structure and a second flange positioned proximate a second end portion of the assembly structure. The electrical assembly further includes at least one lamella coupled to the assembly structure. The at least one lamella extends from the first flange to the second flange.

9 Claims, 5 Drawing Sheets

ELECTRICAL ASSEMBLY AND METHOD FOR MAKING THE SAME

BACKGROUND OF THE INVENTION

The embodiments described herein relate generally to an electrical assembly and, more particularly to an electrical assembly for use with a rotary transformer.

At least one known rotor assembly for use in a rotary transformer includes a plurality of stacked plates, or laminations. The plates each include a central aperture defined therethrough for coupling the plates to a rotor core. More specifically, the rotor core is inserted through the central apertures such that the plates are stacked axially along the rotor core. Further, each plate is generally circular and includes cut-outs or other recesses defined along a circumferential end of the plate to support windings. At least some known windings extend substantially parallel to a longitudinal axis of the rotor core and are supported within the cut-outs or recesses defined by the stack of plates.

BRIEF DESCRIPTION OF THE INVENTION

In one aspect, an electrical assembly for use with a rotary transformer is provided. The electrical assembly includes a assembly structure having a first flange positioned proximate a first end portion of the assembly structure and a second flange positioned proximate a second end portion of the assembly structure. The electrical assembly further includes at least one lamella coupled to the assembly structure. The at least one lamella extends from the first flange to the second flange.

In another aspect, a rotary transformer is provided. The rotary transformer includes a stator assembly and a rotor assembly positioned proximate the stator assembly. The stator assembly and/or the rotor assembly includes an electrical assembly having a assembly structure. The assembly structure includes a first flange positioned proximate a first end portion of the assembly structure and a second flange positioned proximate a second end portion of the assembly structure. The electrical assembly further includes at least one lamella coupled to the assembly structure. The at least one lamella extends from the first flange to the second flange.

In yet another aspect, a method for making an electrical assembly including at least one lamella and a assembly structure is provided. The assembly structure has a first flange proximate a first end portion of the assembly structure and a second flange proximate a second end portion of the assembly structure. The method includes coupling the at least one lamella to the assembly structure at the first flange of the assembly structure and the second flange of the assembly structure. The at least one lamella extends from the first flange to the second flange. A locking ring is coupled to the assembly structure to secure the at least one lamella against the first flange and the second flange.

BRIEF DESCRIPTION OF THE DRAWINGS

FIG. 1 is a cross-sectional view of an exemplary rotary transformer.

FIG. 2 is a cross-sectional view of an exemplary rotor assembly that may be used with the rotary transformer shown in FIG. 1.

FIG. 3 is a perspective view of the rotor assembly shown in FIG. 2.

FIG. 4 is a cross-sectional view of an exemplary stator assembly that may be used with the rotary transformer shown in FIG. 1.

FIG. 5 is a perspective view of the stator assembly shown in FIG. 4.

DETAILED DESCRIPTION OF THE INVENTION

The embodiments described herein provide a rotor assembly and/or a stator assembly having axially-aligned lamellas, or plates, rather than axially-stacked plates. The rotor assembly and the stator assembly are each considered to be or include an electrical assembly. The herein-described lamellae are arrayed circumferentially about a rotor core. Each lamella includes fastening members, such as a foot and a hook, that enable each lamella to be coupled to the rotor core, without the rotor core being inserted through the lamella. When a stator assembly includes lamellae, the fastening members enable each lamella to be coupled to a housing. The rotor core and the housing are each considered to be an assembly structure. Each assembly structure includes flanges that engage with the fastening members of the lamella to facilitate coupling the lamella to the rotor core or housing. A locking ring secures the fastening members of the lamella to the flanges of the assembly structure. The rotor assembly and/or stator assembly described herein can be used within a rotary transformer.

Figure 1:
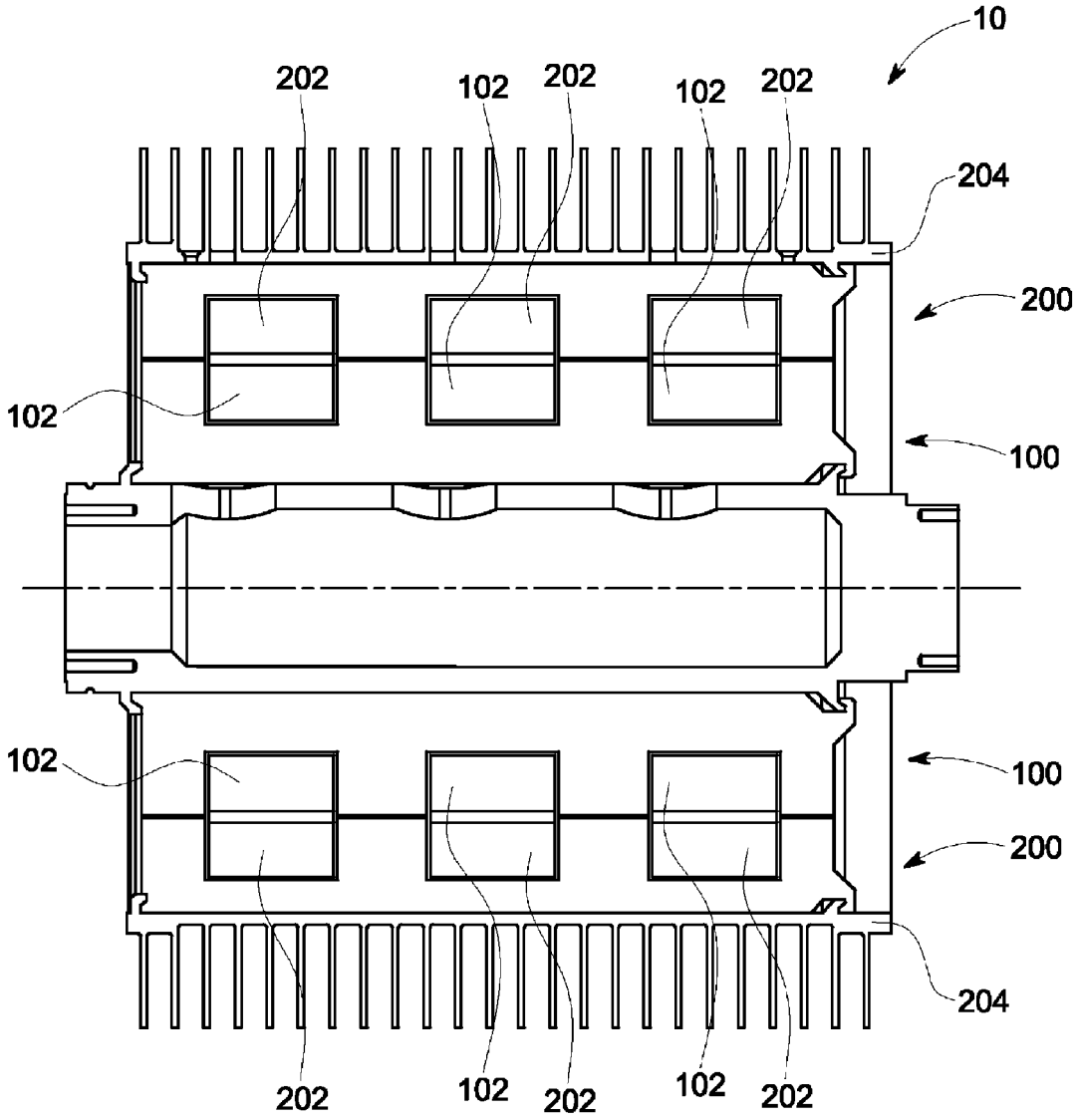
FIGS. 1-5 show exemplary embodiments of the apparatus and methods described herein.

FIG. 1 is a cross-sectional view of an exemplary rotary transformer 10. In the exemplary embodiment, rotary transformer 10 includes a rotor assembly 100 and a stator assembly 200 within a housing 204. Rotor assembly 100 is positioned proximate stator assembly 200 for transfer of magnetic flux between rotor assembly 100 and stator assembly 200. Although stator assembly 200 is coupled to housing 204 in the exemplary embodiment, it should be understood that housing 204 may rotate about a stationary central stator of rotary transformer 10. In the exemplary embodiment, stator assembly 200 includes stator windings 202 and rotor assembly 100 includes rotor windings 102 that are not in physical contact with stator windings 202.

Figure 2:
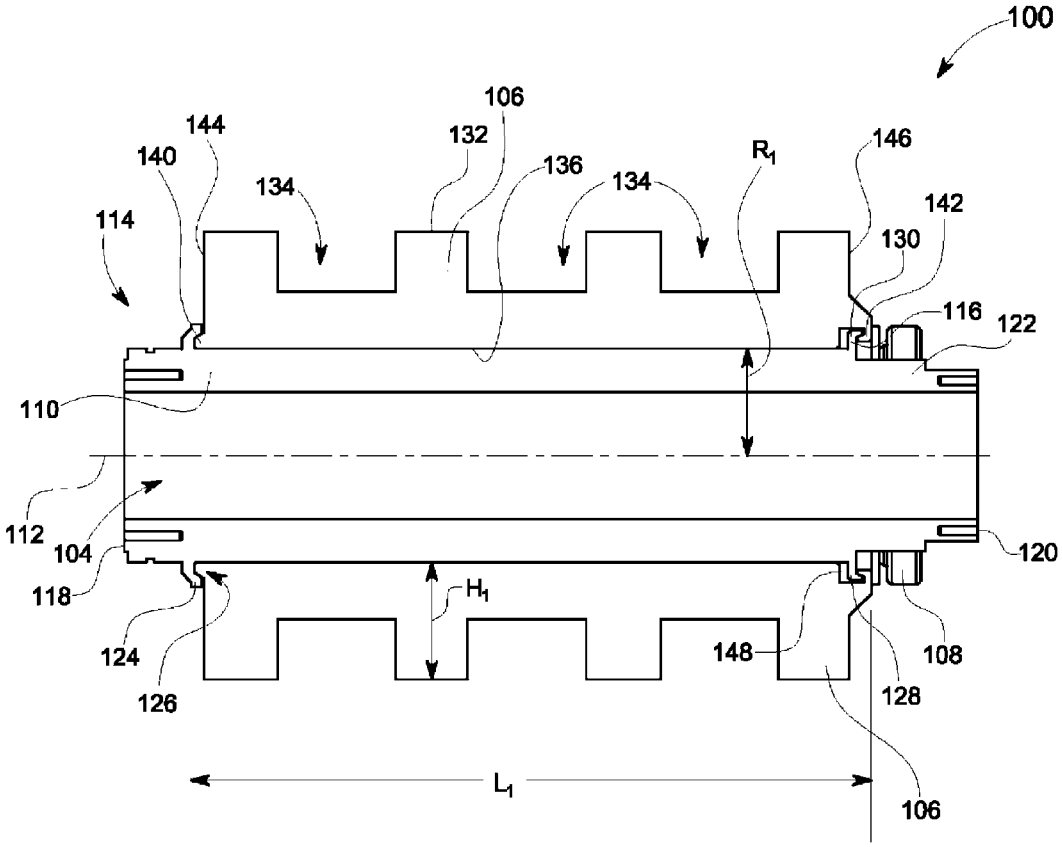
Figure 3:
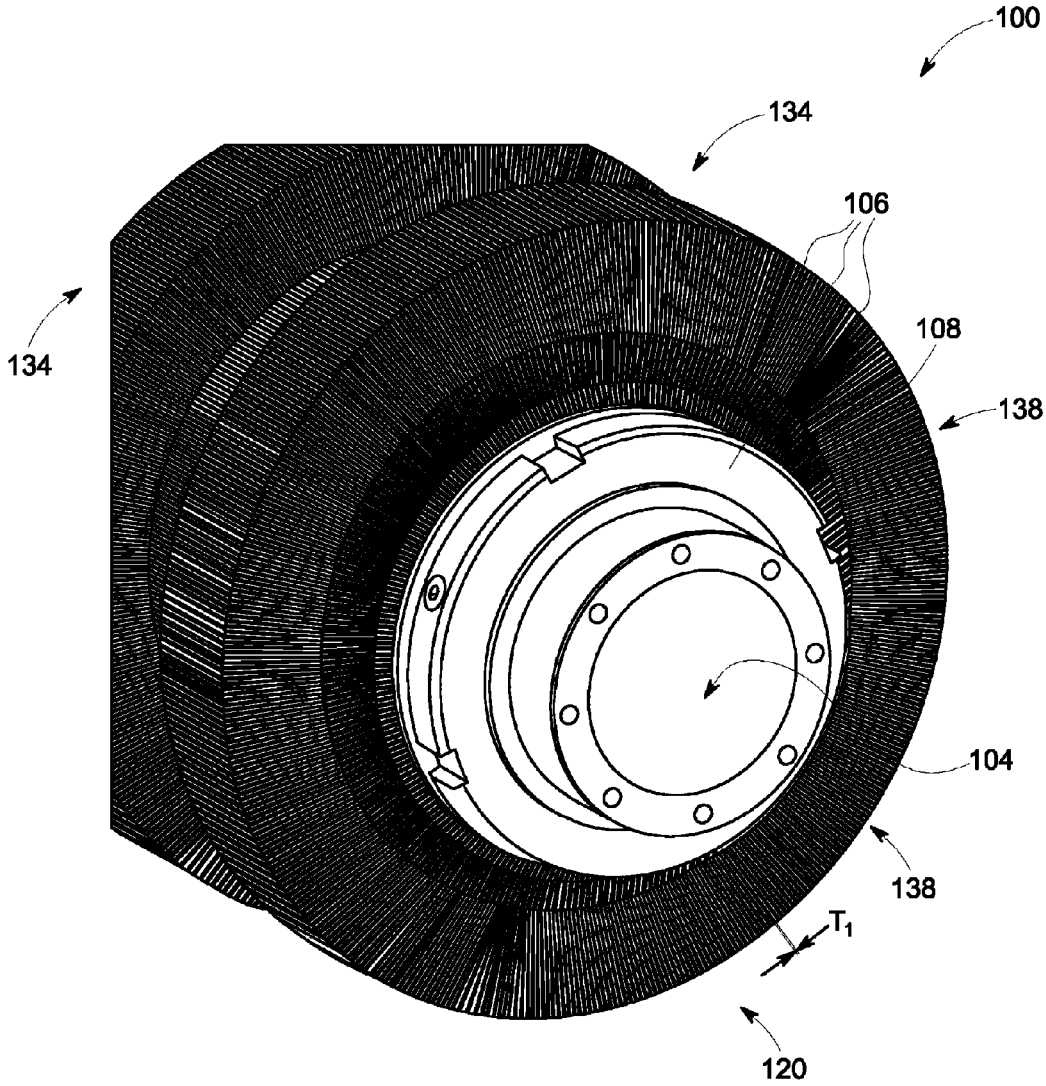

FIG. 2 is a cross-sectional view of an exemplary rotor assembly 100, also referred to as an electrical assembly, that may be used with rotary transformer 10 (shown in FIG. 1). FIG. 3 is a perspective view of rotor assembly 100. Rotor assembly 100 includes a rotor core 104, at least one lamella 106, and a locking ring 108. In the exemplary embodiment, lamella 106 is coupled to rotor core 104 and secured thereto by locking ring 108, as described in more detail herein. More specifically, lamella 106 is in contact with rotor core 104. Rotor core 104, also referred to as an assembly structure, includes a body 110 defining a longitudinal axis 112 of rotor assembly 100. A radius $R_1$ of rotor core 104 is substantially perpendicular to longitudinal axis 112. A first flange 114 and a second flange 116 extend from body 110. More specifically, first flange 114 is defined near a first end portion 118 of body 110, and second flange 116 is defined near an opposing second end portion 120 of body 110. A fastening portion 122 of body 110 is defined between second flange 116 and second end portion 120. In the exemplary embodiment, fastening portion 122 is threaded to engage locking ring 108; however, fastening portion 122 can include any suitable mechanism for interlocking and/or engaging with locking ring 108 to secure lamella 106 to rotor core 104.

First flange 114 defines includes a lip 124 and an annular channel 126 defined between body 110 and lip 124. More specifically, lip 124 extends outwardly about a circumference of body 110 and toward second end portion 120 to define annular channel 126. Second flange 116 includes an annular projection 128. More specifically, second flange 116 is substantially perpendicular to longitudinal axis 112 and extends circumferentially about body 110. As such, second flange 116 extends in a radial direction from body 110. Annular projection 128 extends from a peripheral end 130 of second flange 116 toward second end portion 120. In the exemplary embodiment, lamella 106 is coupled to rotor core 104 at first flange 114 and second flange 116, as described in more detail below.

Each lamella 106 of rotor assembly 100 is substantially similar. More specifically, each lamella 106 is configured to couple to rotor core 104 and to support at least one rotor winding 102. In the exemplary embodiment, each lamella 106 includes an outer end 132 configured to support rotor winding 102 thereon. As such, outer end 132 is configured to correspond to rotor winding 102 fir magnetic flux exchange. Rotor winding 102 is configured to wrap circumferentially about a plurality of lamellae 106 and/or rotor assembly 100. In a particular embodiment when rotor assembly 100 includes three windings 102, outer end 132 of lamella 106 defines three recesses 134 each configured to have a respective winding 102 positioned therein. Alternatively, outer end 132 includes any suitable configuration that enables rotor assembly 100 to function as described herein.

Lamella 106 is shaped as a thin, generally rectangular plate in the exemplary embodiment. More specifically, lamella 106 has a length $L_1$ extending along rotor core body 110 substantially parallel to longitudinal axis 112 when lamella 106 is coupled to rotor core 104. Further, lamella 106 has a height $H_1$ extending from rotor core body 110 radially outward when lamella 106 is coupled to rotor core 104. As such, lamella length $L_1$ extends in an axial direction, and lamella height $H_1$ extends in a radial direction. In the exemplary embodiment, length $L_1$ is larger than height $H_1$. A thickness $T_1$ of lamella 106 is measured tangentially to the circumference of rotor core 104. Thickness $T_1$ is substantially constant along height $H_1$ of lamella 106. Alternatively, thickness $T_1$ varies along at least a portion of height $H_1$ of lamella 106.

In the exemplary embodiment, rotor assembly 100 includes a plurality of lamellae 106 coupled about rotor core 104. Lamellae 106 are coupled in series circumferentially about rotor core 104, rather than being axially stacked. Lamellae 106 are adjacent each other and/or in contact at inner ends 136 of each lamella 106, and a gap 138 is defined between adjacent lamellae 106 along height $H_1$. Alternatively, lamellae 106 are in contact other than at inner ends 136 of each lamella 106. In the exemplary embodiment, a thickness of gap 138 increases from inner end 136 of lamella 106 toward outer end 132 of lamella 106. Alternatively, each lamella 106 has a thickness that increases from inner end 136 toward outer end 132 such that gap 138 has a substantially constant thickness and/or such that gap 138 is substantially eliminated.

Each lamella 106 includes a foot 140 and a hook 142. Foot 140 is positioned at inner end 136 of lamella 106 and extends from a first end 144 of lamella 106. Hook 142 extends from a second end 146 of lamella 106. In the exemplary embodiment, foot 140 is configured to be received within annular channel 126 to couple lamella 106 to rotor core 104. As such, foot 140 has a shape that corresponds to a shape of annular channel 126. Hook 142 is configured to interlock with annular projection 128 to couple lamella 106 to rotor core 104. More specifically, hook 142 defines a notch 148 configured to receive annular projection 128 and/or second flange 116. Hook 142 is shaped to interlock with annular projection 128 when lamella 106 is coupled to rotor core 104. In the exemplary embodiment, foot 140 and channel 126 are configured to secure lamella 106, radially and axially, to rotor core 104. Similarly, hook 142 and annular projection 128 are configured to secure lamella 106, radially and axially, to rotor core 104.

Locking ring 108 is configured to couple to rotor core 104 to secure at least one lamella 106 to rotor core 104. More specifically, in the exemplary embodiment, locking ring 108 is configured to engage and/or interlock with fastening portion 122 of rotor core 104. In a particular embodiment, locking ring 108 includes threads to enable locking ring 108 to be screwed onto threads of fastening portion 122. Alternatively, locking ring 108 includes any suitable configuration that enables locking ring 108 to function as described herein. In the exemplary embodiment, locking ring 108 is configured to force hook 142 against annular projection 128 to secure hook 142 against annular projection 128. By forcing hook 142 against annular projection 128, locking ring 108 also forces foot 140 into annular channel 126.

Referring to FIGS. 2 and 3, to make, assemble, and/or otherwise manufacture rotor assembly 100, at least one lamella 106 is coupled to rotor core 104 at first flange 114 and second flange 116. As described above, lamella 106 has length $L_1$ substantially parallel to longitudinal axis 112 of rotor core 104 when coupled to rotor core 104. As such, lamella 106 extends from first flange 114 to second flange 116 when coupled to rotor core 104. In the exemplary embodiment, lamella 106 is positioned against rotor core body 110 at, for example, inner ends 136 of each lamella 106. When lamella 106 is positioned against rotor core body 110, second flange 116 and/or annular projection 128 are positioned within notch 148. Lamella 106 is slid toward first end portion 118 to insert foot 140 into annular channel 126. As lamella 106 is slid, hook 142 and annular projection 128 interlock. In the exemplary embodiment, a plurality of lamellae 106 are coupled in series circumferentially to rotor core 104 by repeating the above-described steps. In a particular embodiment, lamellae 106 are laminated together.

When at least one lamella 106 is coupled to rotor core 104, locking ring 108 is coupled to rotor core 104 to secure lamella 106 to rotor core 104 at first flange 114 and second flange 116. More specifically, locking ring 108 forces lamella 106 toward first end portion 118 of rotor core 104 to force hook 142 against annular projection 128 and to force foot 140 into annular channel 126 when locking ring 108 engages rotor core 104. In the exemplary embodiment, locking ring 108 is threadably coupled to rotor core 104 to apply a force to hook 142, wherein the force has a direction from second flange 116 toward first flange 114. When locking ring 108 secures lamella 106 to rotor core 104, mating configurations, such as foot 140 and channel 126 and/or hook 142 and annular projection 128, prevent axial and/or radial movement of lamella 106 with respect to rotor core 104. Rotor windings 102 are then coupled about a circumference of, and supported by, lamellae 106.

Figure 4:
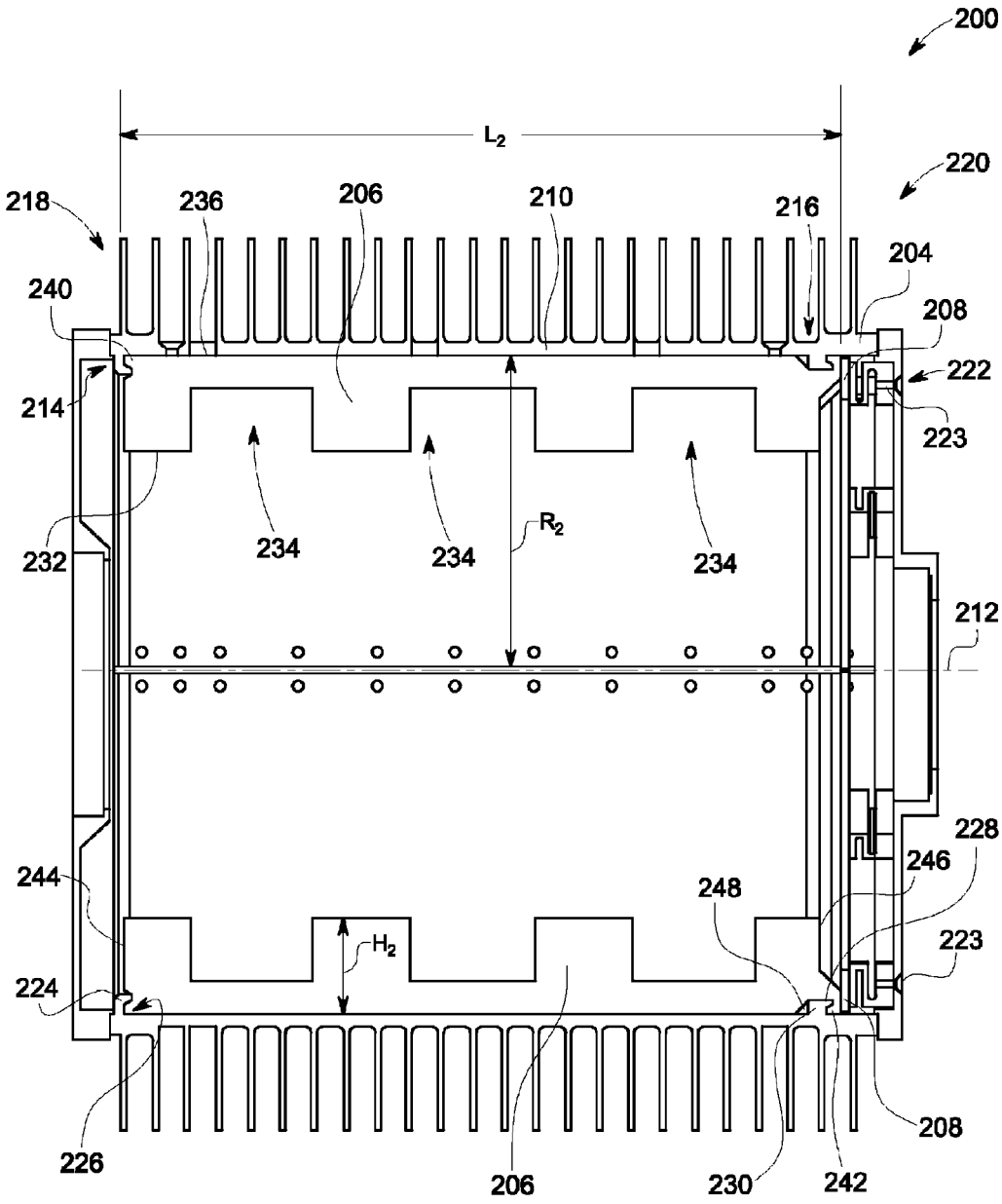
Figure 5:
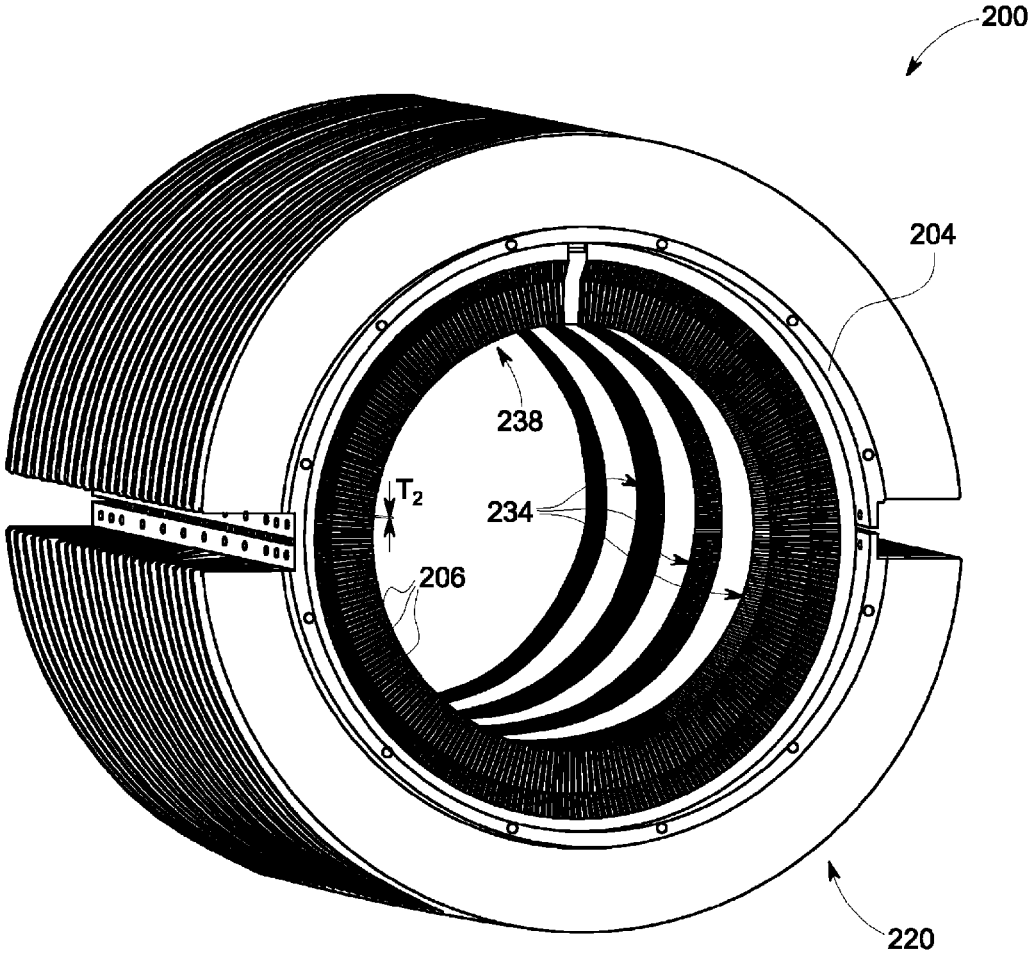

FIG. 4 is a cross-sectional view of an exemplary stator assembly 200, also referred to as an electrical assembly, that may be used with rotary transformer 10 (shown in FIG. 1). FIG. 5 is a perspective view of stator assembly 200. Stator assembly 200 includes housing 204, at least one lamella 206, and a locking ring 208. In the exemplary embodiment, lamella 206 is coupled to housing 204 and secured thereto by locking ring 208, as described in more detail herein. More specifically, lamella 206 is in contact with housing 204. Housing 204, also referred to as an assembly structure, includes a body 210 defining a longitudinal axis 212 of stator assembly 200. A radius $R_2$ of housing 204 is substantially perpendicular to longitudinal axis 212. A first flange 214 and a second flange 216 extend radially inward from body 210. More specifically, first flange 214 is defined near a first end portion 218 of body 210, and second flange 216 is defined near an opposing second end portion 220 of body 210. A fastening portion 222 of housing 204 is defined proximate second end portion 220. In the exemplary embodiment, fastening portion 222 is compressible against locking ring 208 to engage locking ring 208. More specifically, at least one screw 223 can be tightened against locking ring 208 to engage with locking ring 208. However, fastening portion 222 can include any suitable mechanism for interlocking and/or engaging with locking ring 208 to secure lamella 206 to housing 204.

First flange 214 defines includes a lip 224 and an annular channel 226 defined between body 210 and lip 224. More specifically, lip 224 extends outwardly about a circumference of body 210 and toward second end portion 220 to define annular channel 226. Second flange 216 includes an annular projection 228. More specifically, second flange 216 is generally perpendicular to longitudinal axis 212 and extends circumferentially about body 210. As such, second flange 216 extends in a radial direction from body 210. Annular projection 228 extends from a peripheral end 230 of second flange 216 toward second end portion 220. In the exemplary embodiment, lamella 206 is coupled to housing 204 at first flange 214 and second flange 216, as described in more detail below.

Each lamella 206 of stator assembly 200 is substantially similar. More specifically, each lamella 206 is configured to couple to housing 204 and to support at least one stator winding 202. In the exemplary embodiment, each lamella 206 includes an inner end 232 configured to support stator winding 202 thereon. As such, inner end 232 is configured to correspond to stator winding 202. Stator winding 202 is configured to wrap circumferentially about a plurality of lamellae 206 and/or stator assembly 200. In a particular embodiment when stator assembly 200 includes three windings 202, inner end 232 of lamella 206 defines three recesses 234 each configured to have a respective winding 202 positioned therein. Alternatively, inner end 232 includes any suitable configuration that enables stator assembly 200 to function as described herein.

Lamella 206 is shaped as a thin, generally rectangular plate in the exemplary embodiment. More specifically, lamella 206 has a length $L_2$ extending along rotor core body 210 substantially parallel to longitudinal axis 212 when lamella 206 is coupled to housing 204. Further, lamella 206 has a height $H_2$ extending from body 210 radially outward when lamella 206 is coupled to housing 204. As such, lamella length $L_2$ extends in an axial direction, and lamella height $H_2$ extends in a radial direction. In the exemplary embodiment, length $L_2$ is larger than height $H_2$. A thickness $T_2$ of lamella 206 is measured tangentially to the circumference of housing 204. Thickness $T_2$ is substantially constant along height $H_2$ of lamella 206. Alternatively, thickness $T_2$ varies along at least a portion of height $H_2$ of lamella 206.

In the exemplary embodiment, stator assembly 200 includes a plurality of lamellae 206 coupled about housing 204. Lamellae 206 are coupled in series circumferentially about housing 204, rather than being axially stacked. Lamellae 206 are adjacent each other and/or in contact at outer ends 236 of each lamella 206, and a gap 238 is defined between adjacent lamellae 206 along height $H_2$. Alternatively, lamellae 206 are in contact other than at outer ends 236 of each lamella 206. In the exemplary embodiment, a thickness of gap 238 decreases from outer end 236 of lamella 206 toward inner end 232 of lamella 206. Alternatively, each lamella 206 has a thickness that decreases from outer end 236 toward inner end 232 such that gap 238 has a substantially constant thickness and/or such that gap 238 is substantially eliminated.

Each lamella 206 includes a foot 240 and a hook 242. Foot 240 is positioned at outer end 236 of lamella 206 and extends from a first end 244 of lamella 206. Hook 242 extends from a second end 246 of lamella 206. In the exemplary embodiment, foot 240 is configured to be received within annular channel 226 to couple lamella 206 to housing 204. As such, foot 240 has a shape that corresponds to a shape of annular channel 226. Hook 242 is configured to interlock with annular projection 228 to couple lamella 206 to housing 204. More specifically, hook 242 defines a notch 248 configured to receive annular projection 228 and/or second flange 216. Hook 242 is shaped to interlock with annular projection 228 when lamella 206 is coupled to housing 204. In the exemplary embodiment, foot 240 and channel 226 are configured to secure lamella 206, radially and axially, to housing 204. Similarly, hook 242 and annular projection 228 are configured to secure lamella 206, radially and axially, to housing 204.

Locking ring 208 is configured to couple to housing 204 to secure at least one lamella 206 to housing 204. More specifically, in the exemplary embodiment, locking ring 208 is configured to engage and/or interlock with fastening portion 222 of housing 204. In a particular embodiment, fastening portion 222 is configured to be compressible using any suitable mechanism, such as screw 223. When fastening portion 222 is compressed, fastening portion 222 applies a force to locking ring 208, which pushes hook 242 against annular projection 228 to secure hook 242 against annular projection 228. By forcing hook 242 against annular projection 228, locking ring 208 and/or fastening portion 222 also forces foot 240 into annular channel 226. Alternatively, locking ring 208 and/or fastening portion 222 includes any suitable configuration that enables locking ring 208 to function as described herein. For example, locking ring 208 and/or fastening portion 222 can include threads to enable locking ring 208 to be screwed onto fastening portion 222.

Referring to FIGS. 4 and 5, to make, assemble, and/or otherwise manufacture stator assembly 200, at least one lamella 206 is coupled to housing 204 at first flange 214 and second flange 216. As described above, lamella 206 has length $L_2$ substantially parallel to longitudinal axis 212 of housing 204 when coupled to housing 204. As such, lamella 206 extends from first flange 214 to second flange 216 when coupled to housing 204. In the exemplary embodiment, lamella 206 is positioned against body 210 at, for example, outer ends 236 of each lamella 206. When lamella 206 is positioned against body 210, second flange 216 and/or annular projection 228 are positioned within notch 248. Lamella 206 is slid toward first end portion 218 to insert foot 240 into annular channel 226. As lamella 206 is slid, hook 242 and annular projection 228 interlock. In the exemplary embodiment, a plurality of lamellae 206 are coupled in series circumferentially to housing 204 by repeating the above-described steps. In a particular embodiment, lamellae 206 are laminated together.

When at least one lamella 206 is coupled to housing 204, locking ring 208 is coupled to housing 204 to secure lamella 206 to housing 204 at first flange 214 and second flange 216. More specifically, locking ring 208 forces lamella 206 toward first end portion 218 of housing 204 to force hook 242 against annular projection 228 and to force foot 240 into annular channel 226 when locking ring 208 engages with housing 204. In the exemplary embodiment, fastening portion 222 is compressed against locking ring 208 to apply a force to hook 242, wherein the force has a direction from second flange 216 toward first flange 214. When locking ring 208 secures lamella 206 to housing 204, mating configurations, such as foot 240 and channel 226 and/or hook 242 and annular projection 228, prevent axial and/or radial movement of lamella 206 with respect to housing 204. Stator windings 202 are then coupled about a circumference of, and supported by, lamellae 206.

Referring to FIGS. 1-5, to make, assemble, and/or otherwise manufacture rotary transformer 10, stator assembly 200 is provided as described above. Rotor assembly 100 as described above is also provided. Rotor assembly 100 is inserted into stator assembly 200 such that rotor windings 102 align with stator windings 202. Alternatively, a conventional stator assembly is provided, and rotor assembly 100 is inserted into the conventional stator assembly. In an alternative embodiment, a conventional rotor assembly is provided, and stator assembly 200 is coupled about the conventional rotor assembly.

Exemplary embodiments of an electrical assembly and method for making the same are described above in detail. The methods and apparatus are not limited to the specific embodiments described herein, but rather, components of systems and/or steps of the methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electrical assembly for use with a rotary transformer, said electrical assembly comprising:

an assembly structure comprising:

a first flange positioned proximate a first end portion of said assembly structure wherein said first flange defines an annular channel;

a second flange positioned proximate a second end portion of said assembly structure wherein said second flange includes an annular projection; and at least one lamella coupled to said assembly structure at said first flange and said second flange, said at least one lamella extending from said first flange to said second flange, wherein said at least one lamella comprises a foot configured to be received within said annular channel to couple said at least one lamella to said assembly structure.

2. An electrical assembly in accordance with claim 1 further comprising a locking ring configured to couple to said assembly structure to secure said at least one lamella to said assembly structure.

3. An electrical assembly in accordance with claim 1, wherein said at least one lamella comprises a plurality of lamellae coupled to said assembly structure in series about a circumference of said assembly structure.

4. An electrical assembly in accordance with claim 1, wherein said assembly structure has a longitudinal axis and a radius substantially perpendicular to the longitudinal axis, and said at least one lamella having a length that is substantially parallel to the longitudinal axis and a height that extends in a radial direction, wherein the length is larger than the height.

5. An electrical assembly for use with a rotary transformer, said electrical assembly comprising:

an assembly structure comprising:

a first flange positioned proximate a first end portion of said assembly structure wherein said first flange defines an annular channel;

a second flange positioned proximate a second end portion of said assembly structure wherein said second flange includes an annular projection; and at least one lamella coupled to said assembly structure at said first flange and said second flange, said at least one lamella extending from said first flange to said second flange, wherein said at least one lamella comprises a hook configured to interlock with said annular projection to couple said at least one lamella to said assembly structure.

6. An electrical assembly in accordance with claim 5 further comprising a locking ring configured to couple to said assembly structure to secure said at least one lamella to said assembly structure.

7. An electrical assembly in accordance with claim 5 further comprising a locking ring coupled to said assembly structure to secure said hook against said annular projection.

8. An electrical assembly in accordance with claim 5, wherein said at least one lamella comprises a plurality of lamellae coupled to said assembly structure in series about a circumference of said assembly structure.

9. An electrical assembly in accordance with claim 5, wherein said assembly structure has a longitudinal axis and a radius substantially perpendicular to the longitudinal axis, and said at least one lamella having a length that is substantially parallel to the longitudinal axis and a height that extends in a radial direction, wherein the length is larger than the height.

* * * * *